US008729419B2

(12) United States Patent
Mishima et al.

(10) Patent No.: US 8,729,419 B2
(45) Date of Patent: May 20, 2014

(54) METAL MICROPARTICLE GENERATOR

(75) Inventors: Yukiko Mishima, Takatsuki (JP); Hiroshi Suda, Takatsuki (JP)

(73) Assignee: Panasonic Corporation, Osaka (JP)

( * ) Notice: Subject to any disclaimer, the term of this patent is extended or adjusted under 35 U.S.C. 154(b) by 27 days.

(21) Appl. No.: 13/318,409

(22) PCT Filed: May 20, 2010

(86) PCT No.: PCT/JP2010/058940

§ 371 (c)(1),
(2), (4) Date: Nov. 1, 2011

(87) PCT Pub. No.: WO2010/137631

PCT Pub. Date: Dec. 2, 2010

(65) Prior Publication Data

US 2012/0045372 A1 Feb. 23, 2012

(30) Foreign Application Priority Data

May 26, 2009 (JP) ..... 2009-126270

(51) Int. Cl.
*B22F 9/14* (2006.01)
*A45D 20/12* (2006.01)

(52) U.S. Cl.
CPC .. *B22F 9/14* (2013.01); *A45D 20/12* (2013.01)
USPC ..... 219/69.1; 422/186.04

(58) Field of Classification Search
USPC ..... 219/68, 69.1, 69.11; 34/97; 422/186.03, 422/186.04, 186.05, 186.06
See application file for complete search history.

(56) References Cited

U.S. PATENT DOCUMENTS

| | | | | |
|---|---|---|---|---|
| 4,287,404 | A * | 9/1981 | Convers et al. | 219/69.12 |
| 4,341,939 | A * | 7/1982 | Briffod et al. | 219/69.12 |
| 2002/0086145 | A1* | 7/2002 | Yazaki et al. | 428/209 |
| 2003/0108459 | A1* | 6/2003 | Wu et al. | 422/186.04 |
| 2005/0150759 | A1* | 7/2005 | Chang | 204/192.38 |
| 2007/0080054 | A1* | 4/2007 | Parkansky et al. | 422/186.04 |
| 2007/0295695 | A1* | 12/2007 | Tomalin | 219/69.15 |
| 2011/0268619 | A1* | 11/2011 | Machi et al. | 422/186.04 |

FOREIGN PATENT DOCUMENTS

| | | | |
|---|---|---|---|
| JP | 2006-271854 | A | 10/2006 |
| JP | 2008-023063 | | 2/2008 |
| JP | 2008-023063 | A * | 2/2008 |
| JP | 2008-50679 | A * | 3/2008 |
| JP | 2008-308735 | A * | 12/2008 |

OTHER PUBLICATIONS

Machine translation of Japan Patent document No. 2008-50,679-A, Oct. 2013.*
Machine translation of Japan Patent document No. 2008-308,735-A, Oct. 2013.*
Japanese Search Report in corresponding JapanesePatent Application No. 2009-126270, pp. 1-2, dated , Jan. 8, 2013.

* cited by examiner

*Primary Examiner* — Geoffrey S Evans
(74) *Attorney, Agent, or Firm* — Wolf, Greenfield & Sacks, P.C.; Randy J. Pritzker

(57) ABSTRACT

A metal microparticle generator has a discharge electrode formed from a core, which includes platinum, and a cover, which includes zinc and covers the core. A high voltage application unit applies high voltage to the discharge electrode to generate platinum microparticles and zinc microparticles.

5 Claims, 1 Drawing Sheet

METAL MICROPARTICLE GENERATOR

TECHNICAL FIELD

The present invention relates to a metal microparticle generator that generates metal microparticles by performing discharging.

BACKGROUND ART

Known in the prior art, is a metal microparticle generator that generates platinum microparticles by applying high voltage to a discharge electrode, which is formed by a core including platinum.

Japanese Laid-Open Patent Publication No. 2008-23063 describes a prior art example of a metal microparticle generator arranged in a hair dryer, which is used to dry hair or set a hairstyle. The metal microparticle generator provides hair with platinum microparticles when, for example, drying the hair. The platinum microparticles have an antioxidation effect that suppresses hair damage (e.g., removal of cuticle) caused by active oxygen, which is produced by ultraviolet rays.

The metal microparticle generator described in the above publication emits platinum microparticles from the discharge electrode to protect hair from active oxygen, which damages the hair. To further improve the hair protection effect, it is desirable that the platinum microparticles be emitted from the discharge electrode together with other metal microparticles.

SUMMARY OF INVENTION

The present invention provides a metal microparticle generator that efficiently generates platinum microparticles together with other metal microparticles.

One aspect of the present invention is a metal microparticle generator including a discharge electrode formed from a core, which includes platinum, and a cover, which includes zinc and covers the core. A high voltage application unit applies high voltage to the discharge electrode to generate platinum microparticles and zinc microparticles.

In this structure, the electric field intensity becomes higher at the core than the cover. As a result, the sputtering of the core, which includes the platinum having a relatively low sputtering efficiency, is performed with a higher electric field intensity relative to that of the cover, which includes the zinc having a relatively high sputtering efficiency. Thus simultaneously generates the platinum microparticles and the zinc microparticles in a preferable manner.

Preferably, the metal microparticle generator further includes an opposing electrode facing toward the discharge electrode. This structure ensures that discharging is performed by applying voltage between the discharge electrode and the opposing electrode.

Preferably, in the metal microparticle generator, the core is formed from only platinum, and the cover is formed from only zinc. This structure allows for an increase in the amount of platinum microparticles and zinc microparticles that are simultaneously generated.

Preferably, in the metal microparticle generator, the core is elongated, and the cover is formed to cover an outer surface of the core in an axial direction of the core. As an example, the core may be cylindrical. In such a case, the cover may be formed to cover an outer surface of the core. In this case, a diameter of the core and a thickness of the cover are preferably constant in the axial direction of the core. This structure allows for the same generation amount to be set for the platinum microparticles and the zinc microparticles.

Other aspects and advantages of the present invention will become apparent from the following description, taken in conjunction with the accompanying drawings, illustrating by way of example the principles of the invention.

BRIEF DESCRIPTION OF DRAWINGS

The invention, together with objects and advantages thereof, may best be understood by reference to the following description of the presently preferred embodiments together with the accompanying drawings in which.

DESCRIPTION OF EMBODIMENTS

A metal microparticle generator according to one embodiment of the present invention will now be discussed with reference to the drawings. The metal microparticle generator emits platinum microparticles together with other metal microparticles to produce an antioxidation effect for hair. This effectively protects the hair from damage caused by active oxygen.

In one embodiment, the other metal microparticles are, for example, although not limited, zinc microparticles. The metal microparticle generator applies high voltage to a discharge electrode, which preferably includes platinum and zinc, to emit platinum microparticles and zinc microparticles from the discharge electrode. In such a case, the sputtering efficiency of platinum differs from the sputtering efficiency of zinc. In the prior art, this makes it difficult to simultaneously generate platinum microparticles and zinc microparticles in a preferable manner. Thus, a discharge electrode that includes platinum and zinc is not used in conventional metal microparticle generators. The inventors of the present invention have solved this problem.

Figure 1:
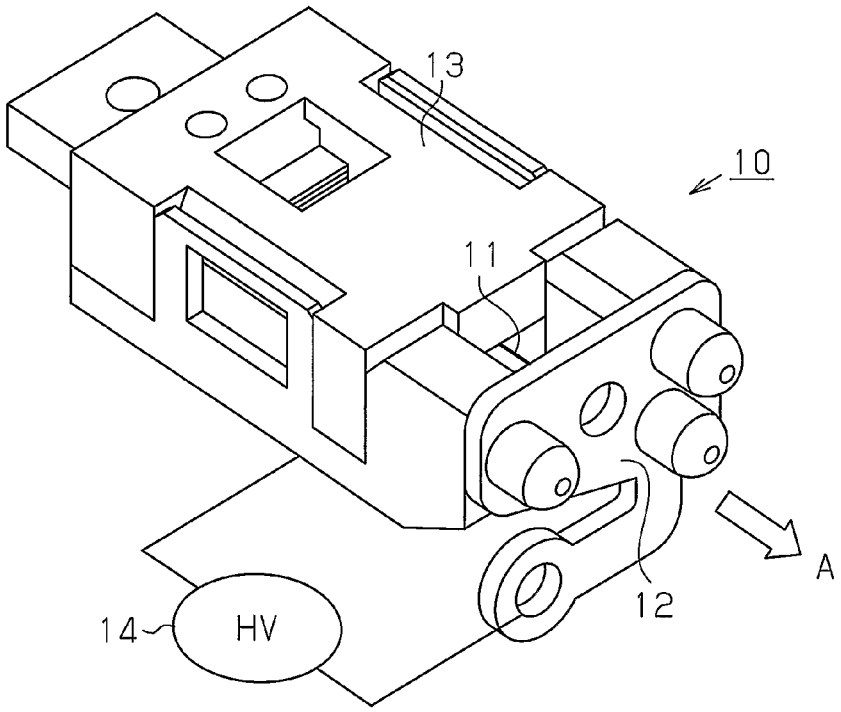
FIG. 1 is a perspective view showing a metal microparticle generator according to one embodiment of the present invention.

FIG. 1 is a perspective view showing a metal microparticle generator 10. The metal microparticle generator 10 includes a discharge electrode 11, an opposing electrode 12, a housing 13 holding the electrodes 11 and 12 at predetermined positions, and a high voltage application unit 14 serving as a high voltage application means that applies high voltage between the discharge electrode 11 and the opposing electrode 12.

Figure 2:
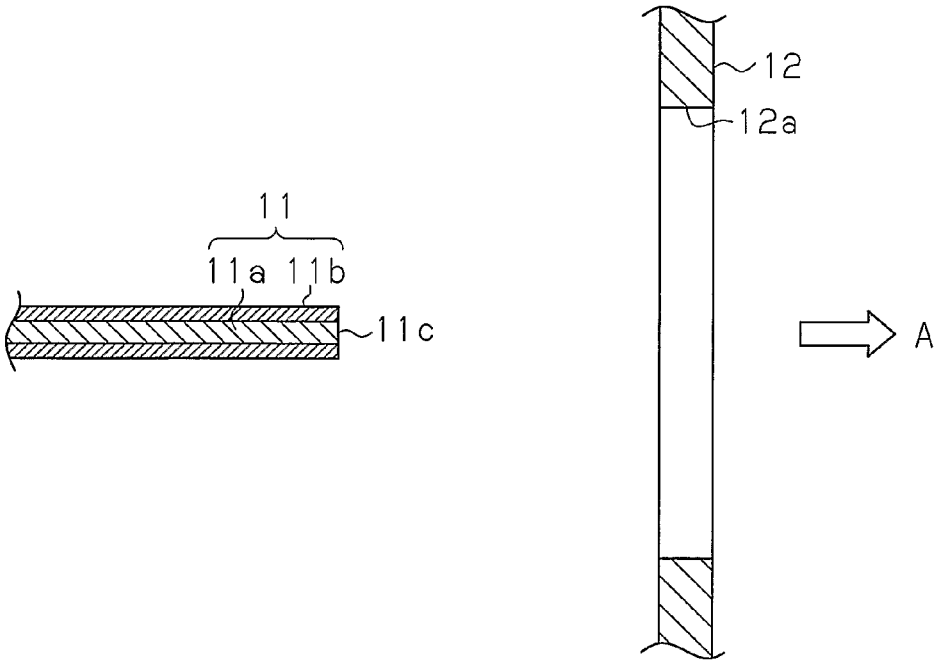
FIG. 2 is a cross-sectional diagram showing a discharge electrode and an opposing electrode of FIG. 1.

Referring to FIG. 2, the discharge electrode 11 includes a core 11*a* and a cover 11*b*, which covers the radially outer side of the core 11*a*. The discharge electrode 11 has a basal end fixed to the housing 13 (refer to FIG. 1). In this embodiment, the core 11*a* is formed from platinum (Pt), and the cover 11*b* is formed from zinc (Zn). Further, the discharge electrode 11 is cylindrical and has a round cross-section as viewed in the axial direction. In this embodiment, the discharge electrode 11 has a cross-sectional size that is constant in the axial direction although the present invention is not limited in such a manner. Further, the core 11*a* has a cross-sectional size (i.e., diameter of the core 11*a*) that is preferably constant in the axial direction, and the cover 11*b* has a cross-sectional size (i.e., thickness of the cover 11*b*) that is preferably constant in the axial direction. The discharge electrode 11 has a distal end that is formed as a circular flat surface 11*c*. The distal end is neither tapered nor spherical. In other words, the flat surface 11*c* is orthogonal or substantially orthogonal to the axial direction of the discharge electrode 11.

The opposing electrode 12, which faces toward the discharge electrode 11, is a planar electrode and arranged at a position spaced from the distal end (flat surface 11*c*) of the discharge electrode 11 in the axial direction of the discharge electrode 11 by a predetermined distance (e.g., 1.5 mm). An emission opening 12*a* extends through the opposing electrode 12 at a position aligned with the axis of the discharge electrode 11. The emission opening 12*a* is formed so that its rim is entirely spaced from the discharge electrode 11 by a constant distance.

The housing 13 is formed from, for example, polycarbonate resin. In addition to fixing the discharge electrode 11 and the opposing electrode 12 to the housing 13, other electronic components may be arranged in the housing 13. The high voltage application unit 14 includes, for example, an igniter type high voltage generation circuit and applies high voltage between the discharge electrode 11 and the opposing electrode 12 to perform discharging.

The generation of platinum microparticles and zinc microparticles with the metal microparticle generator 10 will now be discussed. The high voltage application unit 14 is controlled by, for example, a control unit (not shown).

The high voltage application unit 14 applies high voltage between the discharge electrode 11 and the opposing electrode 12 so that the discharge electrode 11 functions as a negative electrode and the opposing electrode 12 functions as a positive electrode. As a result, discharging occurs at the flat surface 11*c* located on the distal end of the discharge electrode 11. The discharging produces a sputtering phenomenon with positive ions at the flat surface 11*c* of the discharge electrode 11. This emits fine platinum microparticles and fine zinc microparticles toward the opposing electrode 12. In this state, in the discharge electrode 11, the electric field intensity becomes higher at locations that are more inward in the radial direction (locations closer to the center). In other words, the electric field intensity is higher at the core 11*a* than the cover 11*b*. This sputters the core 11*a*, which is formed from platinum that has a lower sputtering efficiency than zinc and is located in the radially inward side of the discharge electrode 11, with the high electric field intensity. Thus, platinum microparticles are efficiently generated. Further, zinc, which has a higher sputtering efficiency than platinum, is used to form the cover member 11*b*. Thus, zone microparticles are efficiently generated even though the electric field intensity is relatively low. Accordingly, platinum microparticles and zinc microparticles are simultaneously generated in a preferable manner.

The platinum microparticles and zinc microparticles emitted from the flat surface 11*c* of the discharge electrode 11 is emitted through the emission opening 12*a* of the opposing electrode 12 in the direction of arrow A, which is shown in FIGS. 1 and 2.

The platinum microparticles generated by the above-described discharging have an antioxidation effect that eliminates active oxygen. Thus, the metal microparticle generator 10 is preferable for use in, for example, a hair dryer. In such a case, hair damage (removal of cuticle) that is caused by active oxygen, which is produced by ultraviolet rays, is suppressed by providing the hair with platinum microparticles. In addition, the zinc microparticles, which are emitted together with the platinum microparticles, also have an antioxidation effect thereby suppressing hair damage (removal of cuticle).

The advantages of the metal microparticle generator 10 will now be described.

(1) The discharge electrode 11 is formed by covering the core 11*a*, which includes platinum, with the cover 11*b*, which includes zinc. More specifically, in the discharge electrode 11, the core 11*a* is formed from platinum, which has a relatively low sputtering efficiency, and the cover 11*b* is formed from zinc, which has a relatively high sputtering efficiency. In this structure, the electric field intensity is higher at the core 11*a* than the cover 11*b*. Therefore, the sputtering of the core 11*a* is performed with a higher electric field intensity relative to the cover 11*b*. This simultaneously generates platinum microparticles and zinc microparticles in a further preferable manner.

(2) The opposing electrode 12 is arranged facing toward the opposing electrode 12. This ensures that discharging is performed by applying voltage between the discharge electrode 11 and the opposing electrode 12.

(3) The core 11*a* is formed from only platinum, and the cover 11*b* is formed from only zinc. This allows for an increase in the amount of platinum microparticles and zinc microparticles that are simultaneously generated.

(4) The diameter of the core 11*a* and the thickness of the cover 11*b* are constant in the axial direction of the core 11*a*. This allows for the same generation amount to be set for the platinum microparticles and the zinc microparticles.

It should be apparent to those skilled in the art that the present invention may be embodied in many other specific forms without departing from the scope of the invention. Particularly, it should be understood that the present invention may be embodied in the following forms.

The core 11*a* may be formed by a member that partially includes platinum, and the cover 11*b* may be formed by a member that partially includes zinc.

The core 11*a* is not limited to a cylindrical shape and may have, for example, a polyhedral shape. Alternatively, the core 11*a* may have another elongated shape.

The opposing electrode 12 does not have to be arranged at a position facing toward the discharge electrode 11. It is only required that the opposing electrode 12 be arranged so as to allow for the discharge electrode 11 to perform discharging. Further, the opposing electrode 12 may be formed by a charge elimination plate or the housing 13 of the metal microparticle generator 10. Moreover, the metal microparticle generator 10 does not have to use the opposing electrode 12. That is, the high voltage application unit 14 may apply high voltage to the discharge electrode 11 to perform discharging.

The application of the metal microparticle generator 10 is not limited to a hair dryer. For example, the metal microparticle generator 10 may be applied to air conditioning equipment, such as an air conditioner, an air purifier, a humidifier, and a dehumidifier. Such a structure would also simultaneously generate platinum microparticles and zinc microparticles thereby allowing for reduction in hair damage (removal of cuticle).

The present examples and embodiments are to be considered as illustrative and not restrictive, and the invention is not to be limited to the details given herein, but may be modified within the scope and equivalence of the appended claims.

The invention claimed is:

1. A metal microparticle generator comprising:

a discharge electrode formed from a core, which is of platinum, and a cover, which is a film of zinc and covers the core; and a high voltage application unit that applies high voltage to the discharge electrode to generate platinum microparticles and zinc microparticles.

2. The metal microparticle generator according to claim 1, further comprising:

an opposing electrode facing toward the discharge electrode.

3. The metal microparticle generator according to claim 1, wherein the core is elongated and has an outer surface, and the cover is formed by cover the outer surface of the core in an axial direction of the core.

4. The metal microparticle generator according to claim 3, wherein the core is elongated and has an outer surface, and the cover is formed to cover the outer surface of the core in an axial direction of the core.

5. The metal microparticle generator according to claim 4, wherein the core has a diameter, and the cover has a thickness, in which the diameter and thickness are constant in the axial direction of the core.

* * * * *